US006382942B1

(12) United States Patent
Otsuki et al.

(10) Patent No.: US 6,382,942 B1
(45) Date of Patent: May 7, 2002

(54) INTERNAL GEAR OIL PUMP MADE OF ALUMINUM ALLOYS

(75) Inventors: Masato Otsuki; Masahisa Miyahara, both of Omiya; Makoto Yoshida, Hadano; Haruo Okamoto; Akira Fujiki, both of Yokohama; Hiroyuki Nishiyama; Motohiro Suzuki, both of Fuji, all of (JP)

(73) Assignees: Mitsubishi Materials Corporation, Tokyo; Nissan Motor Co., Ltd., Yokohama; JATCO TransTechnology Ltd., Fuji, all of (JP)

( * ) Notice: Subject to any disclaimer, the term of this patent is extended or adjusted under 35 U.S.C. 154(b) by 0 days.

(21) Appl. No.: 09/708,616

(22) Filed: Nov. 9, 2000

(30) Foreign Application Priority Data

Nov. 9, 1999 (JP) ..... 11-317617

(51) Int. Cl.[7] ..... F04C 2/10

(52) U.S. Cl. ..... 418/171; 418/179

(58) Field of Search ..... 418/171, 179

(56) References Cited

U.S. PATENT DOCUMENTS 5,338,168 A * 8/1994 Kondoh et al. ..... 418/179
6,089,843 A * 7/2000 Kondoh ..... 418/171

FOREIGN PATENT DOCUMENTS

EP 0375337 * 6/1990 ..... 418/179
JP 4-314983 * 11/1992 ..... 418/179

* cited by examiner

*Primary Examiner*—John J. Vrablik
(74) *Attorney, Agent, or Firm*—Oblon, Spivak, McClelland, Maier & Neustadt, P.C.

(57) ABSTRACT

An internal gear oil pump made of Al alloys having less mutual damage property and superior wear resistance is provided. The internal gear oil pump has a casing with a gear compartment, a drive gear, and a driven gear, all of which are the structural members of the internal gear oil pump. The casing is constituted of an Al-alloy casting. The drive gear and the driven gear are constituted of a hot plastic working material of Al—Si alloy powder. The hot plastic working material is constituted of an Al—Si alloy having a structure in which unit crystal phases are dispersed in a base matrix by 10 to 40 area percent. by the structural observation with an optical microscope, the unit. crystal phases being harder than the base matrix. The base matrix is constituted of an Al—Si alloy which contains, on weight basis, 10% to 18% Si, 4% to 8% Fe, 1% to 3% Ni, 1% to 3% Cr, and the balance being Al and incidental impurities. The alloy has a structure in which ultrafine grains of intermetallic compounds and Si are dispersed in the matrix. The unit crystal phases are constituted of an Al—Si alloy which contains, on weight basis, 25% to 40% Si, 1% to 3% Fe, 2% to 6% Ni, 0.3% to 2% Cr, and the balance being Al and incidental impurities. The alloy has a structure in which ultrafine grains of intermetallic compounds and Si, and primary Si crystal grains are dispersed in the matrix of the unit crystal phases.

1 Claim, 1 Drawing Sheet

INTERNAL GEAR OIL PUMP MADE OF ALUMINUM ALLOYS

BACKGROUND OF THE INVENTION

1. Field of the Invention

The present invention relates to an internal gear oil pump made of aluminum alloys (hereinafter referred to as "Al alloys"), the structural members thereof being less damaging to one another, exhibiting superior wear resistance, and withstanding cavitation damage in an improved manner.

2. Description of the Related Art

Generally, an internal gear oil pump typically used in the automatic transmission of an internal combustion engine mounted in a vehicle is provided with structural members such as a casing having a gear compartment, a drive gear, and a driven gear, as disclosed in Japanese Patent Unexamined Application Publication No. 8-74747. The gear compartment of the casing accommodates the drive gear and the driven gear.

It is also known in the art that the casing of the internal gear oil pump may be constituted of an Al-alloy casting, as disclosed in Japanese Patent Publication No. 7-101035. The drive gear and the driven gear are constituted of an Al—Si alloy powder hot plastic working material, i.e., an Al—Si alloy powder hot forging material and powder hot extrusion material. The above-described hot plastic working material is constituted of an Al—Si alloy which contains, in weight percent (hereinafter % indicates percent by weight), 12% to 42% Si and 1% to 12% transition metals such as Fe and Ni. The alloy has a structure in which ultrafine grains of intermetallic compounds and Si are dispersed in the matrix thereof. When the Si content is high, primary Si crystal grains are also dispersed in the matrix thereof.

Because internal combustion engines have recently come to accommodate higher speeds and higher outputs, the internal gear oil pumps used therein are also required to endure high-speed driving. However, the above-described conventional internal gear oil pump made of Al alloys (hereinafter referred to as "Al-alloy internal gear oil pump") has the following problems. When the Al-alloy internal gear oil pump is driven at high-speed and when the drive gear and the driven gear are constituted of an Al—Si alloy having a low Si content within the range of 12% to 42%, the wear resistance thereof is drastically degraded. Even when the Si content is set at an intermediate level within the range of 12% to 42%, the wear resistance is still insufficient. When the Si content is set high so that the wear resistance is enhanced, mutual damage among the structural components is increased, shortening the life of the oil pump.

SUMMARY OF THE INVENTION

Accordingly, it is an object of the present invention to provide an Al-alloy internal gear oil pump in which the structural members, particularly the drive gear and the driven gear thereof, are less mutually damaging to each other and yet exhibit superior wear resistance even when the pump is driven at high speeds. The inventors have found through extensive research and experimentation that when the conventional Al-alloy internal gear oil pump includes the drive gear and the driven gear which have the following features, the above-described object can be achieved.

(a) A hot plastic working material of Al—Si alloy powder which constitutes the drive gear and the driven gear is composed of an Al—Si alloy having a structure in which unit crystal phases are dispersed in a base matrix at 10 to 40 area percent by observation of the structure thereof using an optical microscope, the unit crystal phases being harder than the base matrix.

(b) The above-described base matrix is constituted of Al—Si alloy which contains 10% to 18% Si, 4% to 8% Fe, 1% to 3% Ni, 1% to 3% Cr, and the balance being Al and incidental impurities, the alloy having a structure in which ultrafine grains of intermetallic compounds and Si, preferably having an average diameter of 0.01 to 1 $\mu$m, are dispersed in the base matrix.

(c) The above-described unit crystal phase is constituted of an Al—Si alloy which contains 25% to 40% Si, 1% to 3% Fe, 2% to 6% Ni, 0.3% to 2% Cr, and the balance being Al and incidental impurities. The alloy has a structure in which ultrafine grains of intermetallic compounds and Si, preferably having an average diameter of 0.01 to 1 $\mu$m, are dispersed in the matrix of the unit crystal phase. Primary Si crystal grains preferably having an average diameter of 3 to 10 $\mu$m are also dispersed in the matrix of the same.

(d) When the pump is driven at high-speed, the above-described base matrix, being soft due to relatively low Si content, is materially compatible with the base matrix of another structural member, i.e., the base matrices of the drive gear and the driven gear, and with the matrix of an Al-alloy casting. Thus, the mutual damage among the structural components can be reduced. For the engaging surfaces of the drive gear and the driven gear, an engaging surface in which high wear resistance is required, is provided with the unit crystal phases which are relatively hard due to the relatively high Si content and which serve to enhance the wear resistance therebetween. Consequently, the Al-alloy internal gear oil pump of the present invention not only has enhanced resistance to cavitation attack due to the ultrafine grains of intermetallic compounds and Si dispersed in the base matrix and the matrix of the unit crystal phase, but also displays superior functioning for a long period of time.

The present invention is based on the above-described experimental results. The Al-alloy internal gear oil pump of the present invention includes a casing having a gear compartment, a drive gear, and a driven gear, all of which are the structural components of the oil pump. The drive gear and the driven gear are disposed in the gear compartment of the casing. The Al-alloy internal gear oil pump of the present invention has the following features.

(a) The casing is constituted of an Al-alloy casting.

(b) The drive gear and the driven gear are made of an Al—Si alloy powder hot plastic working material, particularly a powder hot forging material and powder hot extrusion material.

(c) The hot plastic working material is constituted of an Al—Si alloy having a structure in which unit crystal phases are dispersed in a base matrix by 10 to 40 area percent by observation of the structure thereof using an optical microscope, the unit crystal phase being harder than the base matrix.

(d) The base matrix is constituted of an Al—Si alloy which contains 10% to 18% Si, 4% to 8% Fe, 1% to 3% Ni, 1% to 3% Cr, and the balance being Al and incidental impurities. The alloy has a structure in which ultrafine grains of intermetallic compounds and Si, preferably having an average diameter of 0.01 to 1 $\mu$m, are dispersed in the base matrix.

(e) The unit crystal phase is constituted of an Al—Si alloy which contains 25% to 40% Si, 1% to 3% Fe, 2% to 6% Ni, 0.3% to 2% Cr, and the balance being Al and incidental impurities, the alloy having the structure in which ultrafine grains of intermetallic compounds and Si, preferably having an average diameter of 0.01 to 1 μm, and primary Si crystal grains, preferably having an average diameter of 3 to 10 μm are dispersed in the matrix of the unit crystal phase.

DESCRIPTION OF THE PREFERRED EMBODIMENTS

Figure 1:
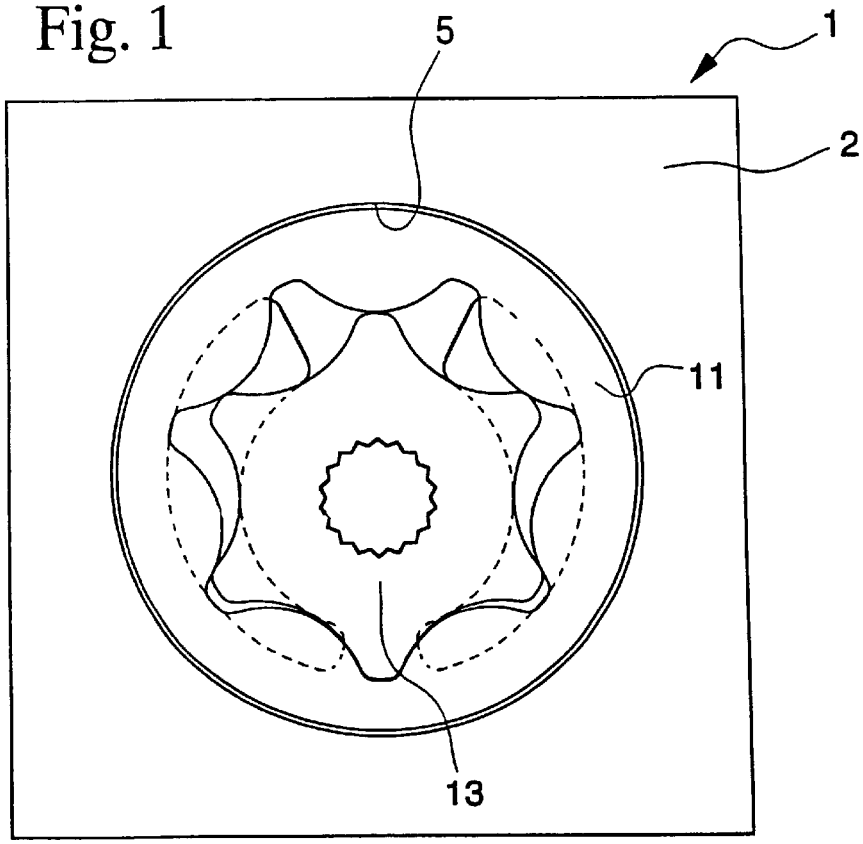
FIG. 1 is a front view of an example of an internal gear oil pump according to the present invention.

Now, the bases for limiting the compositions of the base matrix and the unit crystal phase, composed of an Al—Si alloy which constitutes the drive gear and the driven gear, to the above-described range, and the grounds for limiting the proportion of the unit crystal phases to the above-described proportion will be described.

(A) Composition of the Base Matrix and the Unit Crystal Phase (a) Si

The Si component serves to enhance the resistance to cavitation attack of the matrices. The Si component precipitates in both the base matrix and the unit crystal phases as ultrafine hard Si grains (preferably having an average diameter of 0.01 to 1 μm) and as intermetallic compound grains (preferably having an average grain diameter of 0.01 to 1 μm) when combined with other constituents Al, Fe, Ni and Cr are formed. In the unit crystal phase having a relatively high Si content, Si crystallizes to form hard primary Si crystal grains (preferably having an average diameter of 3 to 10 μm) so that the unit crystal phase has improved wear resistance. The base matrix serves to increase mutual affinity among the structural members and reduce impact damages thereamong.

Accordingly, when Si content in the base matrix is less than 10%, the desired resistance to cavitation attack cannot be obtained. When the Si content exceeds 18%, the primary Si crystal grains crystallize and the damage to the other structural members is increased. Thus the Si content is set to between 10% to 18%, preferably to between 15.5% to 17.5%.

In the unit crystal phase, when the Si content is less than 25%, the desired wear resistance cannot be obtained. When the Si content exceeds 40%, the compatibility brought about by the base matrix is reduced, and mutual damage among the structural members is increased. The tenacity thereof is also reduced. Thus, the Si content is set between 25% to 40%, preferably 30% to 37%.

(b) Fe

The Fe component serves to enhance resistance to cavitation attack. The Fe component combines with other components Al, Si, Ni, and Cr and precipitates in both the base matrix and the unit crystal phase as ultrafine hard intermetallic compound grains. Because the base matrix is more vulnerable to the cavitation damage than is the unit crystal phase, the Fe content is set to between 4% to 8% in the base matrix and to 1% to 3% in the unit crystal phase, so that the distribution density of the intermetallic compound grains in the base matrix is higher.

Accordingly, when the Fe content is less than 4% in the base matrix and less than 1% in the unit crystal phase, the desired resistance to cavitation attack cannot be obtained. When the Fe content exceeds 8% in a base matrix having a relatively low Si content, and 3% in a unit crystal phase having a relatively high Si content, the strength is drastically reduced. Thus, the Fe content in the base matrix is set between 4% to 8%, preferably 5.5% to 6.5%, and in the unit crystal phases, the Fe content is set between 1% to 3%, preferably 1.5% to 2.5%.

(c) Ni

The Ni component serves to form ultrafine intermetallic compound grains dispersed in the base matrix and the unit crystal phases so as to enhance the resistance to cavitation attack. The Ni component also has an effect of enhancing the strength when Ni is included in the matrix as a solid solution. When the Ni content is less than 1% in the base matrix having relatively low Si content and high Fe content, and when the Ni content is less than 2% in the unit crystal phase having relatively high Si content and low Fe content, the desired effect cannot be obtained. When the Fe content exceeds 3% in the base matrix, the intermetallic compounds become coarser, degrading the resistance to cavitation attack. In the unit crystal phase, when the Fe content exceeds 6%, no further improvement is observed. Thus the Fe content in the base matrix is set between 1% to 3%, preferably 1.5% to 2.5%, and the Fe content in the unit crystal phases is set between 2% to 6%, preferably 3.5% to 4.5%.

(d) Cr

The Cr component serves to enhance the strength of the base matrix and the matrix of the unit crystal phase. The Cr component also serves to enhance the resistance to cavitation attack by forming intermetallic compounds as described above, and contributes to spheroidization and particularization of the intermetallic compounds. When the Cr content is less than 1% in the base matrix and less than 0.3% in the unit crystal phase, the above described desired effects cannot be obtained. When Cr content exceeds 3% in the base matrix and 2% in the unit crystal phase, the intermetallic compound grains become coarser, degrading the resistance to cavitation attack. Thus, the Cr content in the base matrix is set to between 1% to 3%, and preferably 1.5% to 2.5%, the Cr content in the unit crystal phases is set to between 0.3% to 2%, preferably 0.5% to 1.5%.

(B) The Proportion of the Unit Crystal Phase

As described above, the base matrix has an effect of reducing mutual damages among structural members while the unit crystal phase has an effect of enhancing wear resistance. When the proportion of the unit crystal phase is less than 10 area percent by observation of the structure thereof using an optical microscope, the desired wear resistance cannot be obtained. When the proportion of the unit crystal phase exceeds 40 area percent, mutual damage among structural members is drastically increased. Thus the proportion of the unit crystal phase is set to between 10 to 40 area percent, and preferably 20 to 30 area percent.

Figure 2:
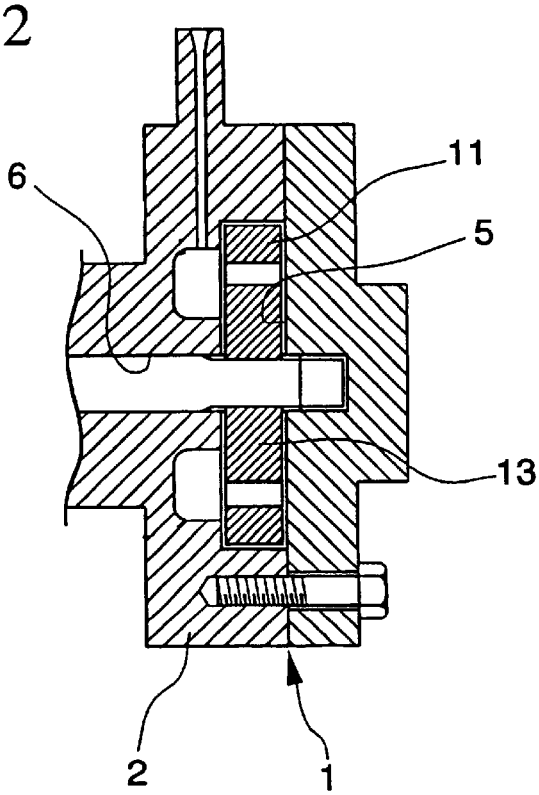
FIG. 2 is a sectional view of the internal gear oil pump.

FIGS. 1 and 2 show an example of an internal gear oil pump according to the present invention. However, the present invention is not limited to this example, and various modifications are possible. This internal gear oil pump 1 comprises a casing 2 having a gear compartment 5, and a drive gear 13 and a driven gear 11 accommodated in the gear compartment 5.

EXAMPLES

Next, the internal gear oil pump of the present invention will be described by way of examples.

First, Al—Si alloy powders $M_1$ to $M_9$ for forming the base matrix (hereinafter referred to as base matrix powders) and Al—Si alloy powders $P_1$ to $P_9$ for forming the unit crystal phase (hereinafter referred to as crystal phase powders), both of which having a composition and an average grain diameter shown in Tables 1 and 2 were prepared as raw material powders by means of a gas atomizing method using air. These raw material powders were mixed in the ratio shown in Tables 3 and 4. After an hour of blending using a V-type blender, the powders were pressed under a pressure of 6 tons/cm$^2$ so as to form green compacts. The green compacts were heated for 30 minutes at a constant temperature of 450° C. in air. The heated green compacts were then hot forged under a pressure of 8 tons/cm$^2$ by using dies also heated to 450° C.

The sample drive gears for use in the internal gear oil pump of the present invention (hereinafter referred to as the drive gears of the present invention) A-1 to A-9 having an inner diameter of 45 mm, an outer diameter of 75 mm at the top lands of the gear teeth, an outer diameter of 60 mm at the bottom lands of the gear, and a thickness of 10 mm were formed.

The sample driven gears for use in the internal gear oil pump of the present invention (hereinafter referred to as the drive gears of the present invention) B-1 to B-9 having an outer diameter of 95 mm, an inner diameter of 75 mm at the top lands of the gear teeth, an inner diameter of 85 mm at the bottom lands of the gear, and a thickness of 10 mm were also formed.

For the purpose of comparison, as shown in Tables 3 and 4, comparative drive gears a-1 to a-9 and comparative driven gears b-1 to b-9 employed in the conventional internal gear oil pump were manufactured under the same conditions as above except that only one of the base matrix powders $M_1$ to $M_9$ or only one of the crystal phase powders $P_1$ to $P_9$ was used as a raw material powder for each comparative drive gear and driven gear.

The structures of these various drive gears and driven gears obtained by the above-described process were then observed using an optical microscope (magnification: 200×). In the drive gears A-1 to A-9 of the present invention and the driven gears B-1 to B-9 of the present invention, the unit crystal phases were dispersed in the base matrix. Ultrafine grains of intermetallic compounds and Si were dispersed in the base matrix. Ultrafine grains of intermetallic compounds and Si, and primary Si crystal grains, were dispersed in the matrix of the unit crystal phase. Furthermore, the proportion of the unit crystal phases was measured by using image analyzer. The results thereof are shown in Tables 3 and 4.

Meanwhile, the comparative drive gears a-1 to a-9 and the comparative driven gears b-1 to b-9 respectively displayed either an uniform structure in which ultrafine grains of intermetallic compounds and Si are dispersed in the matrix thereof when the Si content is low, or a single structure in which ultrafine grains of intermetallic compounds and Si, and primary Si crystal grains, were dispersed in the matrix when the Si content is high.

Furthermore, the casings made of an Al-alloy casting (hereinafter referred to as the casing) C-1 to C-4 were manufactured by means of die-casting. The casings have the compositions shown in Table 5. Each of the casings has a gear compartment having an internal diameter of 95 mm.

Each of the various drive gears and driven gears obtained by the above-described process was mounted in the gear compartment of one of the casings C-1 to C-4 in combinations as shown in Tables 6 and 7. Thus, internal gear oil pumps of the present invention (hereinafter referred to as oil pumps of the present invention) 1 to 9 and comparative internal gear oil pumps equivalent of the conventional internal gear oil pumps (hereinafter referred to as comparative oil pumps) 1 to 9 were assembled.

These various oil pumps underwent high-speed drive testing at 7000 revolutions per minute for 200 hours. After the test, the maximum wear depth at the top of the drive gear teeth and at the bottom of the drive gear, the maximum wear depth at the top of the driven gear teeth and at the bottom of the driven gear, and the maximum wear depth at the inner peripheral face of the casing were respectively measured. The results are shown in Tables 6 and 7.

TABLE 1

| Type | | Composition (wt. %) Si | Fe | Ni | Cr | Al and impurities | Average grain diameter (μm) |
|---|---|---|---|---|---|---|---|
| Base matrix powder | $M_1$ | 10.3 | 5.9 | 2.1 | 2.0 | Balance | 38 |
| | $M_2$ | 16.4 | 6.6 | 1.9 | 2.2 | Balance | 50 |
| | $M_3$ | 17.6 | 6.2 | 2.0 | 1.9 | Balance | 61 |
| | $M_4$ | 16.7 | 4.1 | 2.2 | 2.0 | Balance | 52 |
| | $M_5$ | 16.5 | 7.8 | 2.1 | 1.8 | Balance | 55 |
| | $M_6$ | 16.8 | 6.0 | 1.2 | 2.1 | Balance | 49 |
| | $M_7$ | 16.2 | 5.9 | 2.9 | 2.0 | Balance | 53 |
| | $M_8$ | 16.7 | 6.1 | 1.8 | 1.1 | Balance | 48 |
| | $M_9$ | 16.4 | 6.0 | 2.0 | 2.8 | Balance | 72 |

TABLE 2

| Type | | Composition (wt. %) Si | Fe | Ni | Cr | Al and impurities | Average grain diameter (μm) |
|---|---|---|---|---|---|---|---|
| Crystal phase powder | $P_1$ | 25.2 | 1.9 | 4.1 | 1.1 | Balance | 47 |
| | $P_2$ | 33.4 | 2.2 | 4.0 | 1.0 | Balance | 71 |
| | $P_3$ | 39.8 | 1.8 | 3.9 | 1.1 | Balance | 79 |
| | $P_4$ | 33.7 | 1.5 | 4.1 | 0.9 | Balance | 69 |
| | $P_5$ | 33.2 | 2.8 | 3.8 | 0.9 | Balance | 73 |
| | $P_6$ | 33.8 | 2.0 | 2.1 | 1.2 | Balance | 63 |
| | $P_7$ | 33.5 | 1.9 | 5.8 | 0.9 | Balance | 72 |
| | $P_8$ | 33.5 | 2.1 | 3.8 | 0.3 | Balance | 66 |
| | $P_9$ | 33.6 | 2.2 | 4.0 | 1.8 | Balance | 84 |

TABLE 3

| Type | | Mixture composition (wt. %) Crystal phase powder | Base matrix powder | Proportion of unit crystal phase (area %) | Type | | Mixture composition (wt. %) Crystal phase powder | Base matrix powder | Proportion of unit crystal phase (area %) |
|---|---|---|---|---|---|---|---|---|---|
| Drive gear of the invention | A-1 | $P_1$:11 | $M_3$:Balance | 10.4 | Comparative drive gear | a-1 | $P_1$:100 | — | — |
| | A-2 | $P_2$:25 | $M_2$:Balance | 24.2 | | a-2 | $P_2$:100 | — | — |
| | A-3 | $P_3$:40 | $M_1$:Balance | 39.3 | | a-3 | $P_3$:100 | — | — |
| | A-4 | $P_4$:20 | $M_5$:Balance | 19.6 | | a-4 | $P_5$:100 | — | — |
| | A-5 | $P_5$:23 | $M_4$:Balance | 22.7 | | a-5 | $P_6$:100 | — | — |
| | A-6 | $P_6$:28 | $M_7$:Balance | 29.4 | | a-6 | | $M_1$:100 | — |
| | A-7 | $P_7$:30 | $M_6$:Balance | 31.1 | | a-7 | — | $M_2$:100 | — |
| | A-8 | $P_8$:21 | $M_9$:Balance | 20.7 | | a-8 | — | $M_3$:100 | — |
| | A-9 | $P_9$:24 | $M_8$:Balance | 23.2 | | a-9 | — | $M_7$:100 | — |

TABLE 4

| Type | | Mixture composition (wt. %) Crystal phase powder | Base matrix powder | Proportion of unit crystal phase (area %) | Type | | Mixture composition (wt. %) Crystal phase powder | Base matrix powder | Proportion of unit crystal phase (area %) |
|---|---|---|---|---|---|---|---|---|---|
| Driven gear of the invention | B-1 | $P_1$:10 | $M_3$:Balance | 10.9 | Compartive driven gear | b-1 | $P_1$:100 | — | — |
| | B-2 | $P_2$:25 | $M_2$:Balance | 24.7 | | b-2 | $P_2$:100 | — | — |
| | B-3 | $P_3$:39 | $M_1$:Balance | 39.7 | | b-3 | $P_3$:100 | — | — |
| | B-4 | $P_4$:15 | $M_7$:Balance | 14.2 | | b-4 | $P_5$:100 | — | — |
| | B-5 | $P_5$:20 | $M_6$:Balance | 21.3 | | b-5 | $P_6$:100 | — | — |
| | B-6 | $P_6$:22 | $M_9$:Balance | 22.4 | | b-6 | | $M_1$:100 | — |
| | B-7 | $P_7$:28 | $M_8$:Balance | 27.2 | | b-7 | — | $M_2$:100 | — |
| | B-8 | $P_8$:18 | $M_5$:Balance | 19.6 | | b-8 | — | $M_3$:100 | — |
| | B-9 | $P_9$:24 | $M_4$:Balance | 23.3 | | b-9 | — | $M_7$:100 | — |

TABLE 5

| Type | | Composition (wt. %) Si | Cu | Mg | Fe | Ni | Al and impurities |
|---|---|---|---|---|---|---|---|
| Casing | C-1 | 15.5 | 3.5 | 0.7 | 1.0 | — | Balance |
| | C-2 | 8.5 | 3.0 | 0.3 | 0.2 | — | Balance |
| | C-3 | 11.0 | 2.4 | 0.2 | 1.0 | 0.3 | Balance |
| | C-4 | 18.5 | 1.0 | 1.0 | 0.1 | 1.1 | Balance |

TABLE 6

| Type | | Combination Drive gear No. | Driven gear No. | Casing No. | Maximum wear depth (μm) Top of drive gear | Bottom of drive gear | Top of drive gear | Bottom of driven gear | Inner peripheral face of casing |
|---|---|---|---|---|---|---|---|---|---|
| Oil pump of the invention | 1 | A-1 | B-1 | C-2 | 7.4 | 27.5 | 7.8 | 7.2 | 18.2 |
| | 2 | A-2 | B-2 | C-1 | 4.3 | 13.0 | 4.1 | 4.2 | 4.7 |
| | 3 | A-3 | B-3 | C-3 | 2.9 | 7.3 | 3.0 | 2.0 | 12.1 |
| | 4 | A-4 | B-4 | C-4 | 4.5 | 14.7 | 5.2 | 5.9 | 3.7 |
| | 5 | A-5 | B-5 | C-1 | 4.1 | 14.3 | 4.4 | 4.9 | 4.5 |
| | 6 | A-6 | B-6 | C-1 | 3.2 | 11.9 | 3.8 | 4.5 | 4.6 |
| | 7 | A-7 | B-7 | C-1 | 3.6 | 11.4 | 3.1 | 4.0 | 4.8 |

TABLE 6-continued

| Type | | Combination | | | Maximum wear depth (μm) | | | | |
|---|---|---|---|---|---|---|---|---|---|
| | | Drive gear No. | Driven gear No. | Casing No. | Top of drive gear | Bottom of drive gear | Top of drive gear | Bottom of driven gear | Inner peripheral face of casing |
| | 8 | A-8 | B-8 | C-2 | 4.2 | 14.6 | 6.2 | 4.2 | 14.6 |
| | 9 | A-9 | B-9 | C-2 | 4.6 | 13.5 | 4.5 | 3.5 | 18.2 |

TABLE 7

| Type | | Combination | | | Maximum wear depth (μm) | | | | |
|---|---|---|---|---|---|---|---|---|---|
| | | Drive gear No. | Driven gear No. | Casing No. | Top of drive gear | Bottom of drive gear | Top of driven gear | Bottom of driven gear | Inner peripheral face of casing |
| Comparative Oil pump | 1 | a-1 | b-1 | C-2 | 15.0 | 29.6 | 15.6 | 8.0 | 98.8 |
| | 2 | a-2 | b-2 | C-1 | 17.6 | 16.9 | 19.2 | 8.2 | 35.6 |
| | 3 | a-3 | b-3 | C-3 | 21.0 | 12.7 | 18.1 | 3.8 | 87.4 |
| | 4 | a-4 | b-4 | C-4 | 17.5 | 17.1 | 14.2 | 10.2 | 28.1 |
| | 5 | a-5 | b-5 | C-1 | 17.7 | 16.7 | 14.8 | 8.1 | 29.4 |
| | 6 | a-6 | b-6 | C-1 | 53.9 | 511.2 | 42.6 | 56.7 | 18.6 |
| | 7 | a-7 | b-7 | C-1 | 43.7 | 467.2 | 38.7 | 46.3 | 17.1 |
| | 8 | a-8 | b-8 | C-2 | 42.4 | 324.1 | 37.1 | 41.6 | 101.5 |
| | 9 | a-9 | b-9 | C-2 | 43.7 | 351.3 | 39.5 | 42.9 | 109.8 |

From the results shown in Tables 6 and 7, it is apparent that the oil pumps 1 to 9 of the present invention, each having the drive gear and the driven gear each respectively having a structure in which unit crystal phases are dispersed in the base matrix, have the structural components which cause less damage to one another and exhibit superior wear resistance even at high-speed driving. In contrast, the comparative oil pumps 1 to 9, equipped with the drive gear and the driven gear each having an uniform structure identical to that of the base matrix or the unit crystal phase, show less improvement in mutual damage properties or wear resistance properties, if not both.

In view of the above, the oil pump of the present invention has the structural components which cause less mutual damage and exhibit superior wear resistance even when the oil pump is driven in high-speed. The oil pump of the present invention meets the demand for higher speed and higher output for various internal combustion engines.

What is claimed is:

1. An internal gear oil pump made of Al alloys, comprising a casing having a gear compartment, a drive gear, and a driven gear as structural members, (a) said casing comprising an Al-alloy casting, (b) said drive gear and said driven gear comprising an Al—Si alloy powder hot plastic working material, (c) the hot plastic working material comprising an Al—Si alloy having a structure in which unit crystal phases are dispersed in a base matrix at 10 to 40 area percent by observation of the structure thereof using an optical microscope, the unit crystal phases being harder than the base matrix, (d) the base matrix comprising an Al—Si alloy comprising, on a weight basis, 10% to 18% Si, 4% to 8% Fe, 1% to 3% Ni, 1% to 3% Cr, the balance being Al and incidental impurities, the alloy having a structure in which ultrafine grains of intermetallic compounds and Si are dispersed in the base matrix, and (e) the unit crystal phases comprising an Al—Si alloy comprising, on a weight basis, 25% to 40% Si, 1% to 3% Fe, 2% to 6% Ni, 0.3% to 2% Cr, and the balance being Al and incidental impurities, the alloy having a structure in which ultrafine grains of intermetallic compounds and Si, and primary Si crystal grains are dispersed in the matrix of the unit crystal phases.

* * * * *